US006069960A

United States Patent [19]

Mizukami et al.

[11] Patent Number: 6,069,960

[45] Date of Patent: May 30, 2000

[54] CONNECTOR DEVICE FOR INFORMATION-HANDLING APPARATUS AND CONNECTOR DEVICE FOR STEREOPHONIC AUDIO/VIDEO APPARATUS

[75] Inventors: Kenichi Mizukami; Tooru Shiono, both of Tokyo; Toshitaka Yoshihiro; Tomoyuki Miyakoshi, both of Kanagawa, all of Japan

[73] Assignee: Sony Corporation, Tokyo, Japan

[21] Appl. No.: 08/919,211

[22] Filed: Aug. 28, 1997

[30] Foreign Application Priority Data

Sep. 5, 1996 [JP] Japan ..... 8-235462

[51] Int. Cl.[7] ..... H04R 5/033

[52] U.S. Cl. ..... 381/74; 381/94.5; 381/120; 381/80; 381/123

[58] Field of Search ..... 439/34, 79, 61, 439/536, 936, 668; 381/120, 123, 77, 78, 85, 28; 379/29

[56] References Cited

U.S. PATENT DOCUMENTS 5,034,808 7/1991 Murray ..... 381/82

5,161,198 11/1992 Noble ..... 381/120

5,598,227 1/1997 Mikami ..... 348/706

*Primary Examiner*—Forester W. Isen

*Assistant Examiner*—Brian Tyrone Pendleton

*Attorney, Agent, or Firm*—Jay H. Maioli

[57] ABSTRACT

A connector device for connecting information-handling apparatus has a common jack connected to a first information-handling apparatus, a plurality of plugs connected respectively to a plurality of second information-handling apparatus having respective different impedances, the plugs being selectively connectable to the jack, and a determining circuit for, when one of the plugs is connected to the common jack, applying a predetermined voltage to a contact of the connected plug through an impedance element, detecting a voltage between the contact of the connected plug and a ground contact thereof, detecting an impedance between the contact of the connected plug and the ground contact thereof depending on the detected voltage, and determining the type of the plug or the type of the second information-handling apparatus connected to the plug depending on the detected impedance.

10 Claims, 7 Drawing Sheets

T1
T2
T3
T4

Plug Inserted or Power Supply Turned On
1
0

Control Signal for Switch S1
1
0

Switch S1
ON
OFF

Control Signal for Amplifiers
1
0
X(V)

Voltage at Junction Q
0(V)

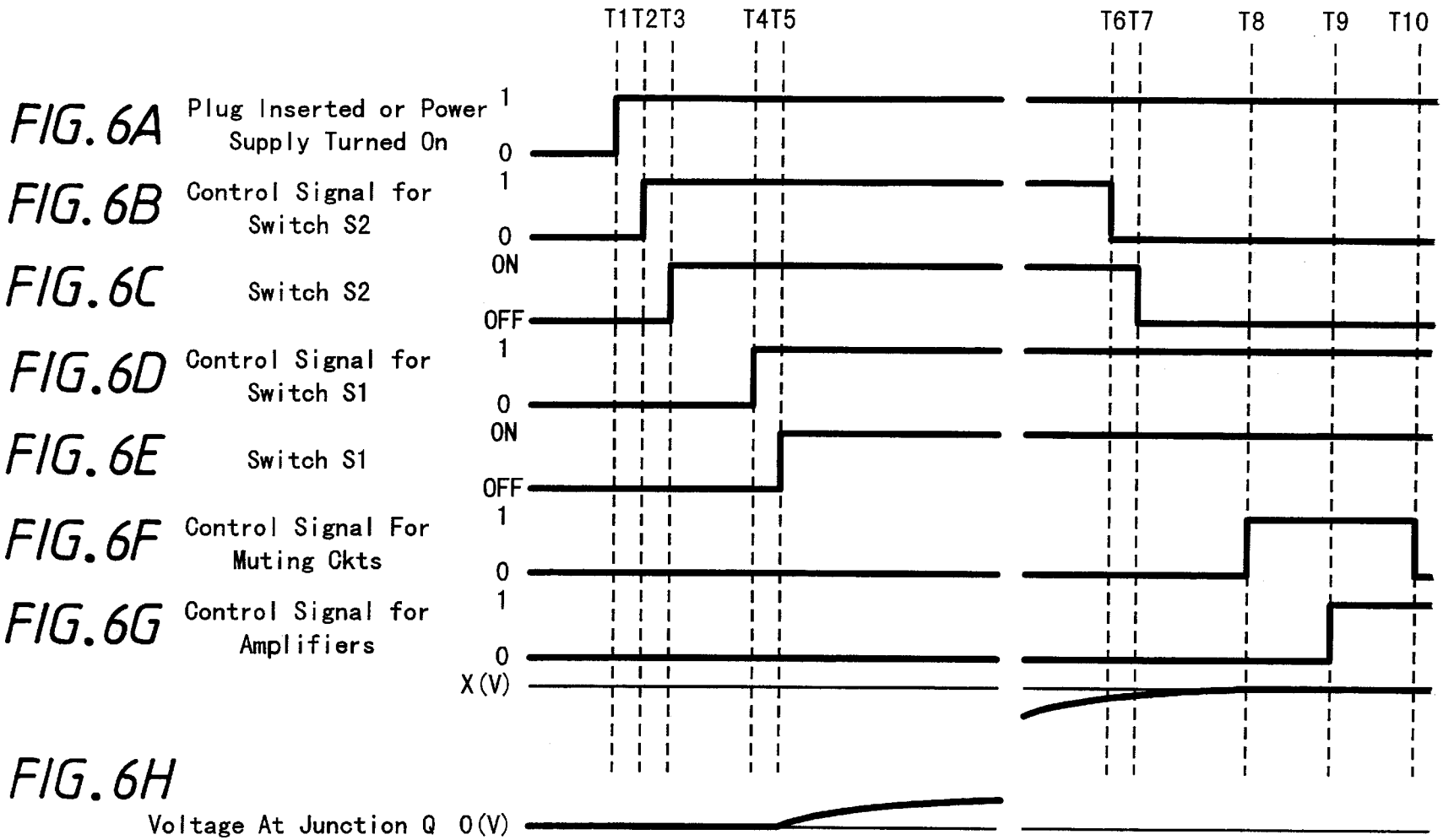
T1T2T3
T4T5
T6T7
T8
T9
T10
FIG. 6A Plug Inserted or Power Supply Turned On
1
0
FIG. 6B Control Signal for Switch S2
1
0
FIG. 6C Switch S2
ON
OFF
FIG. 6D Control Signal for Switch S1
1
0
FIG. 6E Switch S1
ON
OFF
FIG. 6F Control Signal For Muting Ckts
1
0
FIG. 6G Control Signal for Amplifiers
1
0
FIG. 6H Voltage At Junction Q
X(V)
0(V)

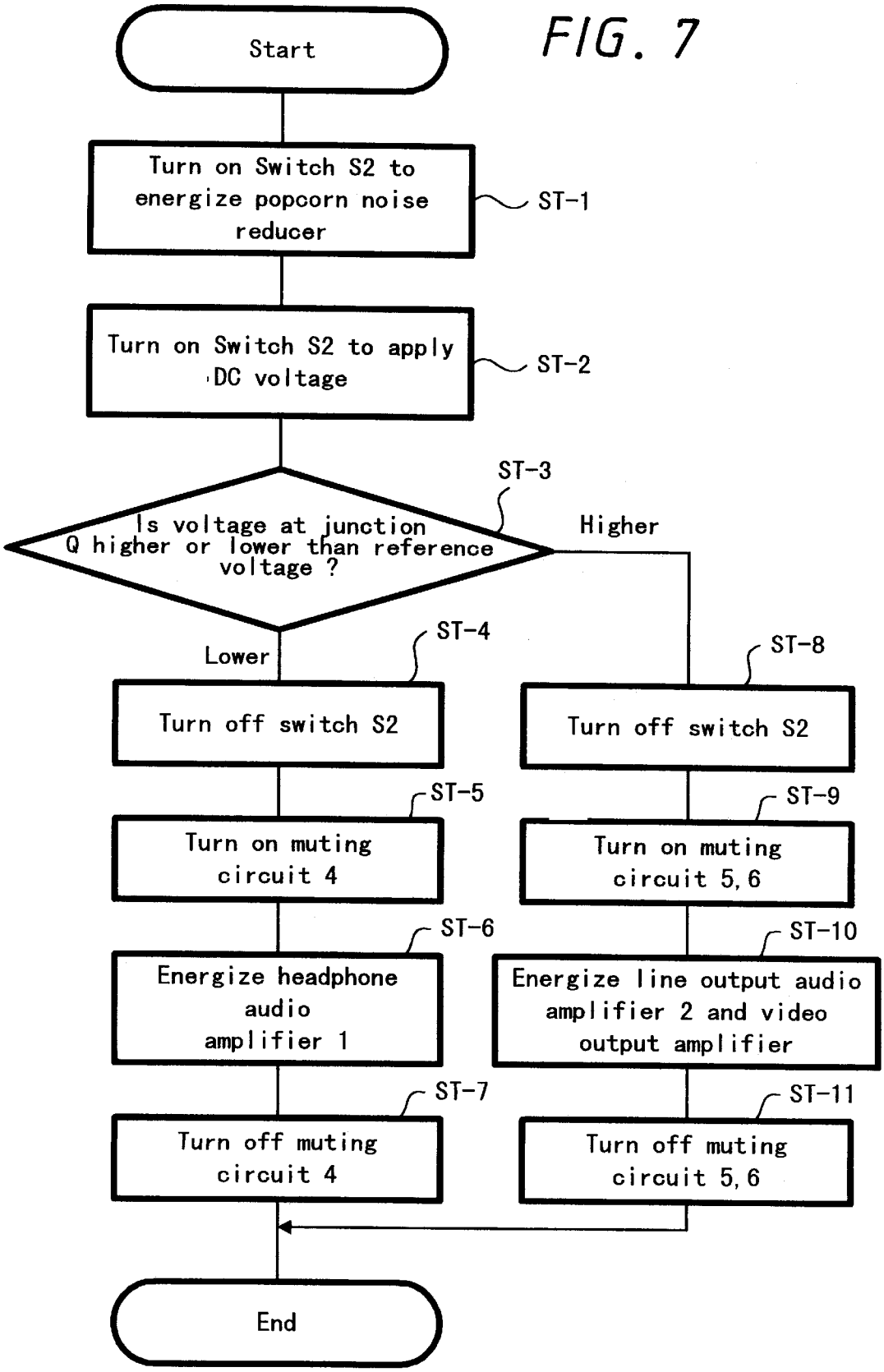
FIG. 7
Start
Turn on Switch S2 to energize popcorn noise reducer
ST-1
Turn on Switch S2 to apply DC voltage
ST-2
ST-3
Is voltage at junction Q higher or lower than reference voltage ?
Higher
Lower
ST-4
Turn off switch S2
ST-5
Turn on muting circuit 4
ST-6
Energize headphone audio amplifier 1
ST-7
Turn off muting circuit 4
ST-8
Turn off switch S2
ST-9
Turn on muting circuit 5, 6
ST-10
Energize line output audio amplifier 2 and video output amplifier
ST-11
Turn off muting circuit 5, 6
End

CONNECTOR DEVICE FOR INFORMATION-HANDLING APPARATUS AND CONNECTOR DEVICE FOR STEREOPHONIC AUDIO/VIDEO APPARATUS

BACKGROUND OF THE INVENTION

1. Field of the Invention

The present invention relates to a connector device for information-handling apparatus and a connector device for stereophonic audio/video apparatus, which connector devices have a jack and plug.

2. Description of the Prior Art

Conventional connector devices for stereophonic audio/video apparatus will be described below. As shown in FIGS. 1A and 1B of the accompanying drawings, there have been known a stereo headphone miniplug P-H and a stereo AV (audio/video) miniplug P-AV, each having an outside diameter of 3.5 mm. The stereo headphone miniplug P-H has a left audio signal contact L, a right audio signal contact R, and a ground contact G, arranged successively from a tip end thereof with insulators (shown solid). The stereo AV miniplug P-AV has a left audio signal contact L, a video signal contact V, a ground contact G, and a right audio signal contact R, arranged successively from a tip end thereof with insulators (shown solid). The first contacts near the tip ends of the stereo headphone miniplug P-H and the stereo AV miniplug P-AV have the same shape and length, and the second contacts near the tip ends of the stereo headphone miniplug P-H and the stereo AV miniplug P-AV have the same shape (cylindrical shape) and length. The ground contact G of the stereo AV miniplug P-AV has the same length as that of the video signal contact V thereof. The lengths of the insulators of the stereo headphone miniplug P-H and the stereo AV miniplug P-AV are equal to each other. The stereo headphone miniplug P-H and the stereo AV miniplug P-AV have respective thick cylindrical portions (not shown) of insulating material remote from the tip ends thereof. The lengths of the stereo headphone miniplug P-H and the stereo AV miniplug P-AV which extend from ends of the cylindrical portions to the tip ends are equal to each other.

To the contacts L, R, G of the stereo headphone miniplug P-H, there are connected to left and right loud-speakers $SP_L$, $SP_R$ of a stereo headphone HP, that is, contacts L, R are connected to speakers $SP_L$, $SP_R$, respectively, and contact G is connected to both speakers $SP_L$, $SP_R$. To the contacts L, V, G, R of the stereo AV miniplug P-AV, there are connected corresponding terminals of an AV (audio/video) apparatus 12 such as a VTR (video tape recorder), a monitor television receiver, etc. The stereo headphone HP has an input impedance ranging from several tens to several hundreds Ω, and the AV apparatus 12 has audio and video input impedances of about 2.2 KΩ.

An AV (audio/video) amplifying apparatus (first AV apparatus) has a headphone audio amplifier for amplifying left and right audio signals, a line output audio amplifier, and a video amplifier for amplifying a video signal. The headphone audio amplifier has output terminals connected to a jack corresponding to the stereo headphone miniplug P-H. The line output audio amplifier and the video amplifier have output terminals connected to a jack corresponding to the stereo AV miniplug P-AV. Plugs are connected to these jacks to supply left and right audio signals from the headphone audio amplifier to the stereo headphone HP and also to supply left and right audio signals from the line output audio amplifier and a video signal from the video amplifier to the AV apparatus 12 (second AV apparatus). The headphone audio amplifier has an output impedance which is substantially equal to the input impedance of the stereo headphone HP, and the line output audio amplifier and the video amplifier have respective output impedances which are substantially equal to the audio and video input impedances of the AV apparatus 12.

It is assumed that the first AV apparatus is regarded as a first information-handling apparatus and the headphone and the second AV apparatus as a plurality of second information-handling apparatuses having different impedances. If the second information-handling apparatuses are to be selectively or simultaneously connected to the first information-handling apparatus by connectors comprising jacks and plugs, then since the first information-handling apparatus needs to have two jacks, the first information-handling apparatus should have a large space for accommodating the connectors.

Furthermore, with the connector devices for stereophonic audio/video apparatus, because the first AV apparatus has two jacks, the first AV apparatus requires a large space for accommodating the connectors.

SUMMARY OF THE INVENTION

It is therefore an object of the present invention to provide a connector device for connecting, to a first information-handling apparatus, a plurality of second information-handling apparatuses having different impedances by connectors comprising jacks and plugs, the connector device allowing the first information-handling apparatus to have a reduced space for accommodating the connectors.

Another object of the present invention is to provide a connector device for connecting, to a first stereo audio/video apparatus comprising first and second stereo audio devices having different first and second impedances, respectively, and a first video device, a third stereo audio device having an impedance which is substantially equal to the first impedance, and a second stereo audio/video apparatus comprising a fourth stereo audio device having an impedance which is substantially equal to the second impedance, and a second video device, through connectors having jacks and plugs, the first stereo audio/video apparatus having a reduced space for accommodating the connectors.

According to the present invention, there is provided a connector device for connecting information-handling apparatuses that has a common jack connected to a first information-handling apparatus, a plurality of plugs connected respectively to a plurality of second information-handling apparatuses having respective different impedances, the plugs being selectively connectable to the jack, and the connector device also includes determining means for, when one of the plugs is connected to the common jack, applying a predetermined voltage to a contact of the connected plug through an impedance element, detecting a voltage between the contact of the connected plug and a ground contact thereof, detecting an impedance between the contact of the connected plug and the ground contact thereof depending on the detected voltage, and determining the type of the plug or the type of the second information-handling apparatus connected to the plug depending on the detected impedance.

When one of the plugs is connected to the common jack, the determining means applies a predetermined voltage to a contact of the connected plug through an impedance element, detects a voltage between the contact of the connected plug and a ground contact thereof, detects an impedance between the contact of the connected plug and the ground contact thereof depending on the detected voltage, and determines the type of the plug or the type of the second information-handling apparatus connected to the plug depending on the detected impedance.

BRIEF DESCRIPTION OF THE DRAWINGS

FIGS. 6A through 6H are timing charts illustrative of the manner in which the connector device according to the second embodiment operates; and FIG. 7 is a flowchart of an algorithm of a plug determining circuit in the connector device according to the second embodiment.

DETAILED DESCRIPTION OF THE PREFERRED EMBODIMENTS

Figure 1A:
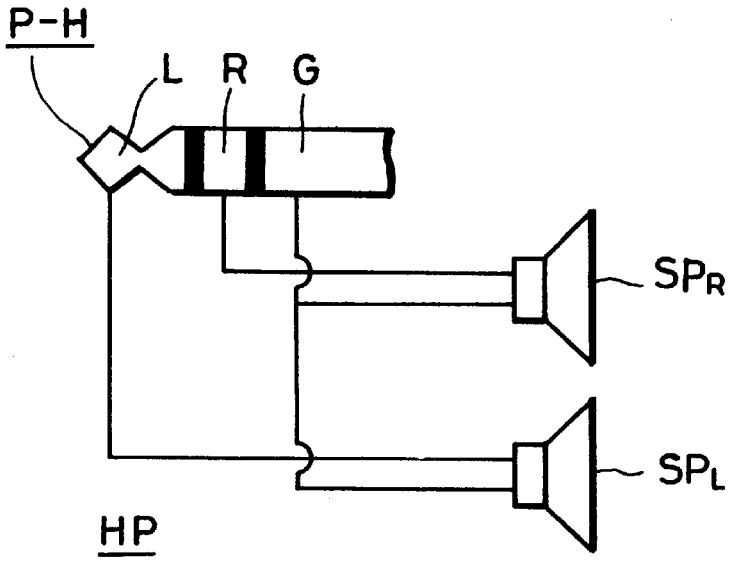
FIG. 1A is a circuit diagram of a stereo headphone miniplug and a headphone connected thereto for use in arrangements according to first and second embodiments of the present invention and a conventional arrangement.
Figure 1B:
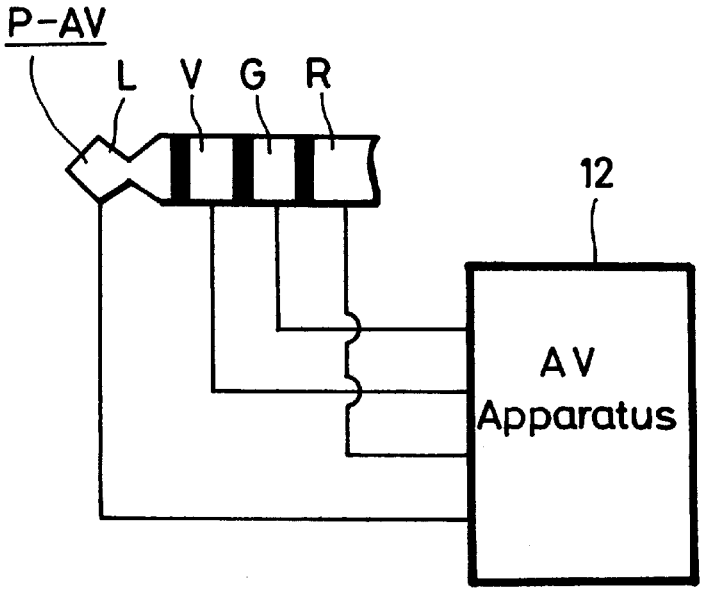
FIG. 1B is a circuit diagram of a stereo AV miniplug and an AV apparatus connected thereto for use in the arrangements according to the first and second embodiments of the present invention and the conventional arrangement.
Figure 2:
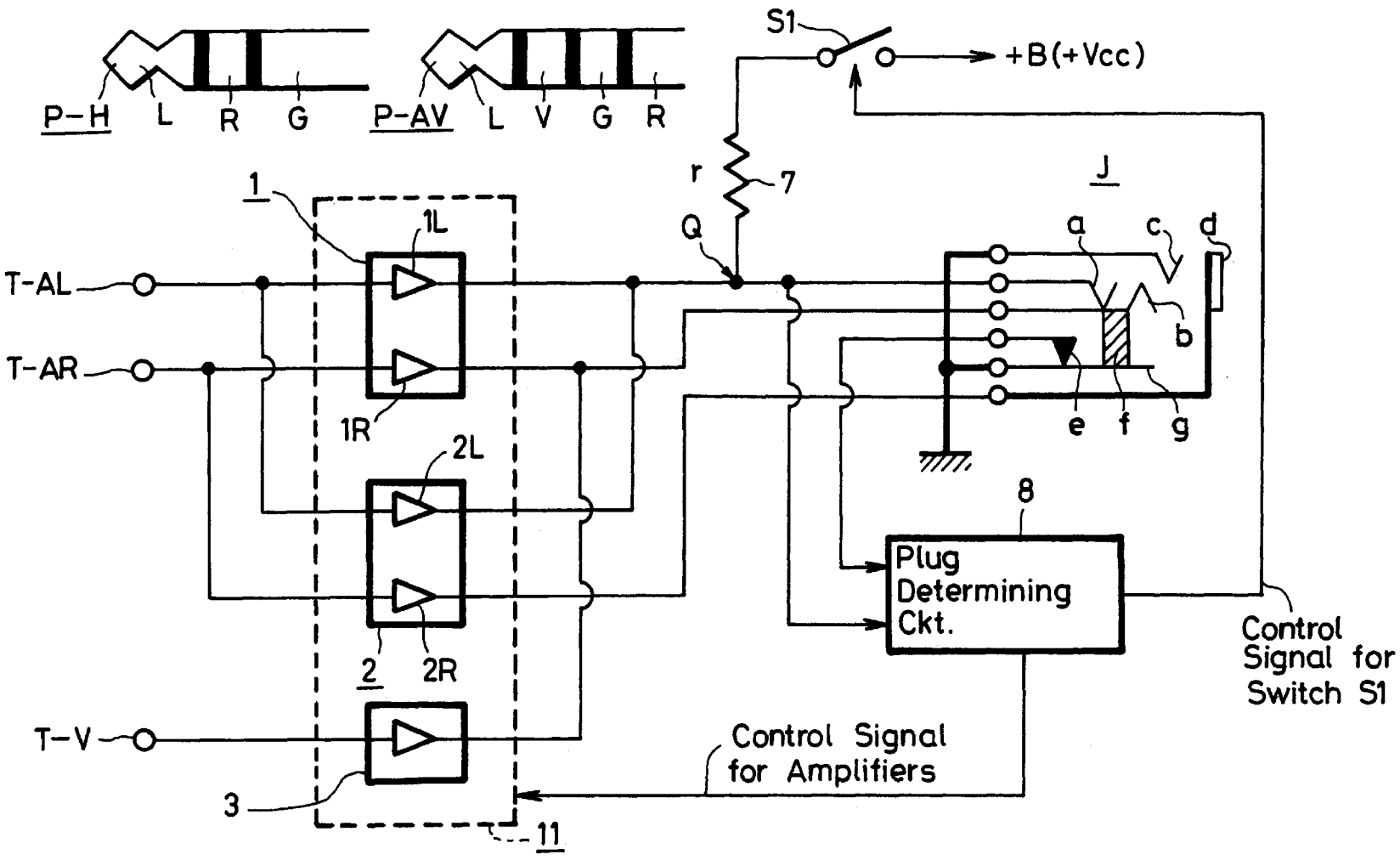
FIG. 2 is a block diagram of a connector device according to the first embodiment.

As shown in FIG. 2, a connector device according to a first embodiment of the present invention has a jack J connected to a first information-handling apparatus or an AV (audio/video) amplifying apparatus 11 acting as a first stereo audio/video apparatus, a stereo headphone miniplug P-H, to which there is connected a second information-handling apparatus shown in FIG. 1A or a stereo headphone HP acting as a third stereo audio device, and a stereo AV (audio/video) miniplug P-AV, to which there is connected a second information-handling apparatus shown in FIG. 1B or a stereo AV (audio/video) apparatus 12 acting as a second stereo audio/video apparatus. The miniplugs P-H, P-AV may be selectively connected to (inserted into) the jack J.

The miniplugs P-H, P-AV, and the devices connected to these plugs will be described below with reference to FIGS. 1A and 1B. FIGS. 1A and 1B show, respectively, the stereo headphone miniplug P-H and the stereo AV (audio/video) miniplug P-AV, each having an outside diameter of 3.5 mm. The stereo headphone miniplug P-H has a left audio signal contact L, a right audio signal contact R, and a ground contact G, arranged successively from a tip end thereof with insulators (shown solid). The stereo AV miniplug P-AV has a left audio signal contact L, a video signal contact V, a ground contact G, and a right audio signal contact R, arranged successively from a tip end thereof with insulators (shown solid). The first contacts near the tip ends of the stereo headphone miniplug P-H and the stereo AV miniplug P-AV have the same shape and length, and the second contacts near the tip ends of the stereo headphone miniplug P-H and the stereo AV miniplug P-AV have the same shape (cylindrical shape) and length. The ground contact G of the stereo AV miniplug P-AV has the same length as that of the video signal contact V thereof. The lengths of the insulators of the stereo headphone miniplug P-H and the stereo AV miniplug P-AV are equal to each other. The stereo headphone miniplug P-H and the stereo AV miniplug P-AV have respective thick cylindrical portions (not shown) of insulating material remote from the tip ends thereof. The lengths of the stereo headphone miniplug P-H and the stereo AV miniplug P-AV which extend from ends of the cylindrical portions to the tip ends are equal to each other.

As shown in FIG. 1A, the left audio signal contact L and the ground contact G of the stereo headphone miniplug P-H are connected to a left loudspeaker $SP_L$ of a stereo headphone HP, and the right audio signal contact R and the ground contact G of the stereo headphone miniplug P-H are connected to a right loudspeaker $SP_R$ of the stereo headphone HP.

As shown in FIG. 1B, the left audio signal contact L, the right audio signal contact R, the video signal contact V, and the ground contact G of the stereo AV miniplug P-AV are connected respectively to left and right audio signal terminals and a video signal terminal of an AV (audio/video) apparatus 12 such as a VTR (video tape recorder), a monitor television receiver, etc.

The jack J, to which the miniplugs P-H, P-AV can be connected, i.e., into which they can be inserted, will be described below with reference to FIG. 2. The jack J has contacts a, b, c, d which can contact the contacts L, R, G of the stereo headphone miniplug P-H when inserted into the jack J, and the contacts L, V, G, R of the stereo AV miniplug P-AV when inserted into the jack J. The contacts a, b contact each other when no plug is inserted into the jack J. When a plug is inserted into the jack J, the contacts a, b contact corresponding contacts of the inserted plug. The jack J has contacts e, g which contact each other when no plug is inserted into the jack J. When a plug is inserted into the jack J, the contact b depresses the contact g through an insulator f, out of contact with the contact e. The contacts c, g are connected to ground.

The AV (audio/video) amplifying apparatus 11 will be described below. The AV (audio/video) amplifying apparatus 11 has a headphone audio amplifier 1 as a first stereo audio apparatus comprising left and right amplifiers 1L, 1R for amplifying respective left and right audio signals supplied from input terminals T-AL, T-AR. The AV (audio/video) amplifying apparatus 11 also has a video output amplifier 3 as a first video apparatus for amplifying a video signal supplied from an input terminal T-V. The AV (audio/video) amplifying apparatus 11 further has a line output audio amplifier 2 as a second stereo audio apparatus comprising left and right amplifiers 2L, 2R for amplifying respective left and right audio signals (audio signals related to the video signal from the input terminal T-V) supplied from the input terminals T-AL, T-AR.

The left amplifier 1L of the headphone audio amplifier 1 and the left amplifier 2L of the line output audio amplifier 2 have respective output terminals connected to the contact a of the jack J. The right amplifier 1R of the headphone audio amplifier 1 and the video output amplifier 3 have respective output terminals connected to the contact b of the jack J. The right amplifier 2R of the line output audio amplifier 2 has an output terminal connected to the contact d of the jack J.

A DC voltage+Vcc of a power supply+B is applied to the contact a of the jack J through a series-connected circuit of an on-off switch S1 and a resistor 7 having a resistance r of 100 Ω, for example. The resistor 7 and the contact a are interconnected through an intermediate junction Q.

A plug determining circuit 8 (plug determining means) is connected to the contacts a, e of the jack J. The on-off switch S1 is controlled so as to be turned on or off by a switch control signal from the plug determining circuit 8. The amplifiers 1, 2, 3 are controlled so as to be switched into and out of operation by an amplifier control signal from the plug determining circuit 8.

Operation of the connector device according to the first embodiment shown in FIG. 2 will be described below with reference to a timing chart shown in FIGS. 3A through 3E and an algorithm of the plug determining circuit 8 shown in FIG. 4.

Figures 3A, 3B, 3C, 3D, 3E:
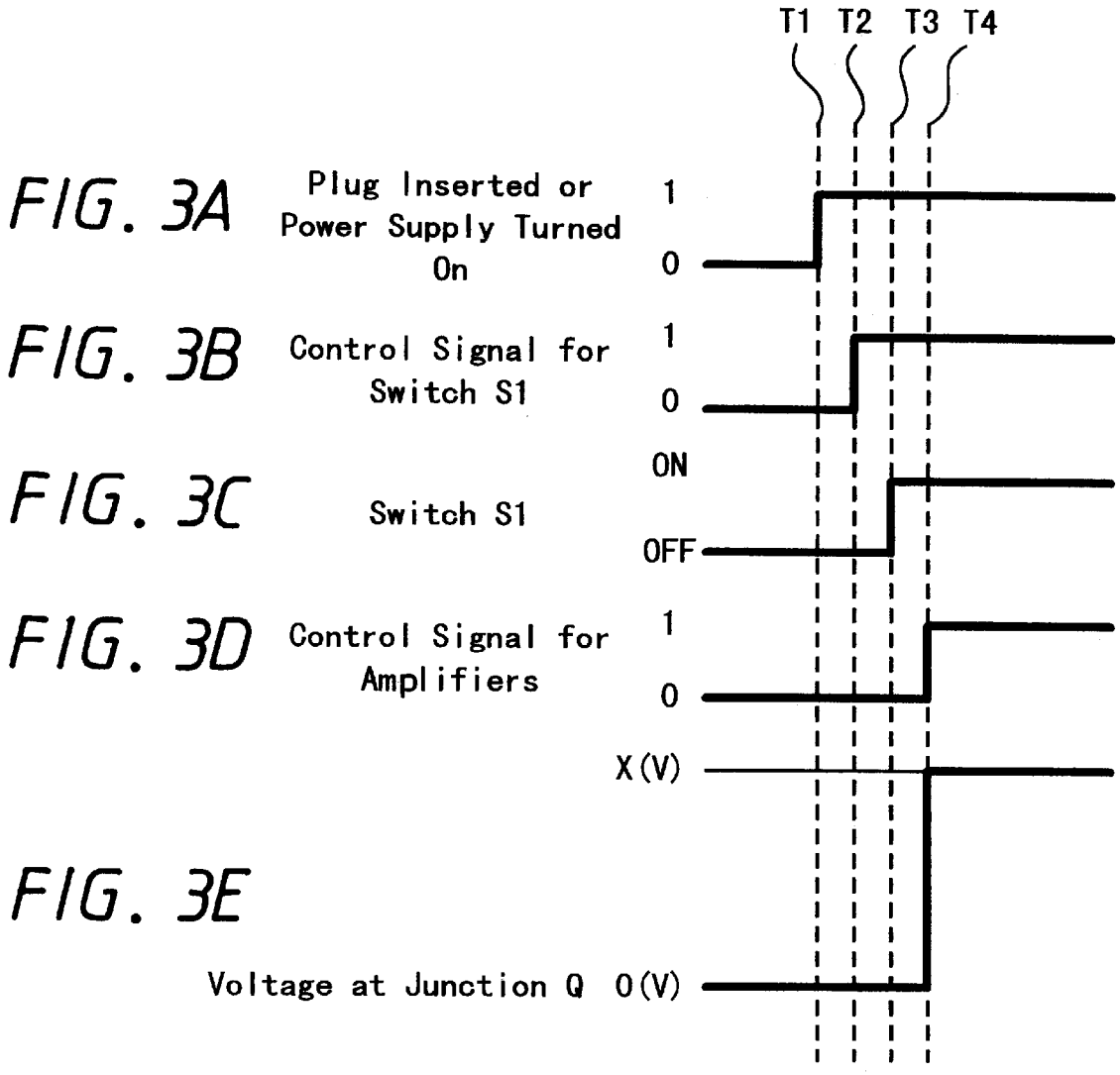
FIGS. 3A through 3E are timing charts illustrative of the manner in which the connector device according to the first embodiment operates.

When the stereo headphone miniplug P-H or the stereo AV miniplug P-AV is inserted into the jack J, the contacts a, b which have been held in contact with each other are separated from each other, and the contact b depresses the contact g through the insulator f, separating the contacts e, g out of contact with each other. It is assumed, as shown in FIG. 3A, that the stereo headphone miniplug P-H or the stereo AV miniplug P-AV is inserted into the jack J at a time t1 while the power supply is being switched on, or the power supply is switched on (whose level changes from a logic 0 to a logic 1) at a time t1 while the stereo headphone miniplug P-H or the stereo AV miniplug P-AV is being inserted in the jack J. The contact e, which has been connected to ground, becomes free, enabling the plug determining circuit 8 to detect that the stereo headphone miniplug P-H or the stereo AV miniplug P-AV is inserted in the jack J at the time t1.

Figure 4:
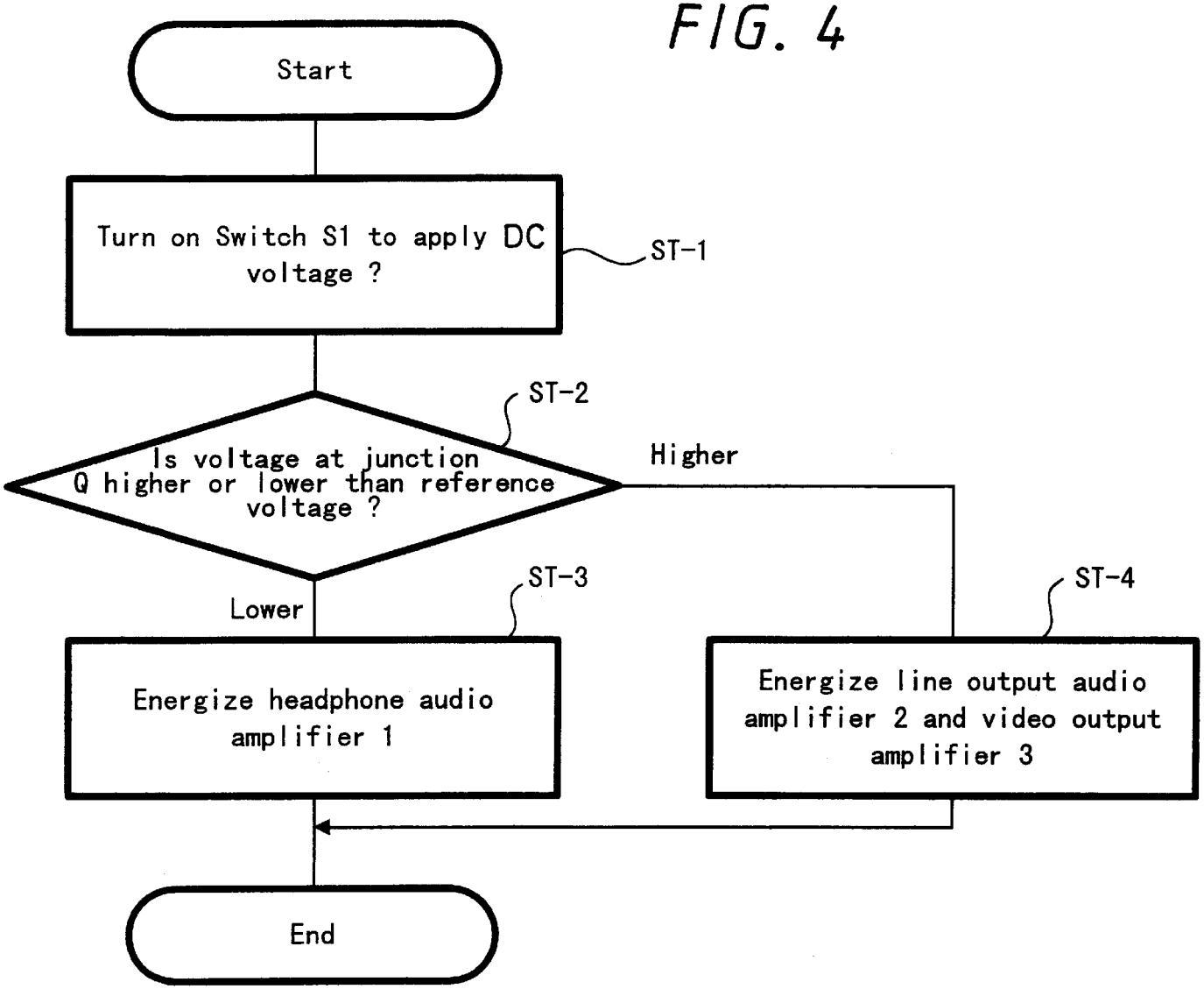
FIG. 4 is a flowchart of an algorithm of a plug determining circuit in the connector device according to the first embodiment.

At a time t2, a certain period after the time tl, the plug determining circuit 8 supplies a control signal (whose level changes from a logic 0 to a logic 1 at the time t2) to turn on the switch S1 to the switch S1, which is turned on at a time t3, a certain period after the time t2, thereby applying the DC voltage+Vcc from the power supply+B through the resistor 7 to the junction Q in a step ST-1 (see FIG. 4). The potential at the junction Q rises from 0 (V) to a voltage X (V), which is supplied to the plug determining circuit 8. The voltage X (V) at the junction Q is expressed by the following equation:

$$X=Vcc\times R/(r+R) \quad (1)$$

where R represents the resistance (impedance) between the contact a and the contact d (contact c) of the jack J, i.e., the impedance between the left audio signal contact L and the ground contact G of the miniplugs P-H, P-AV, and r represents the resistance (impedance) of the resistor 7, which is 100 Ω, for example.

The left and right loudspeakers $SP_L$, $SP_R$ of the second information-handling apparatus connected to the stereo headphone miniplug P-H or the stereo headphone HP as the third audio device have an impedance of several tens to several hundreds Ω. If the impedance has a maximum value of 600 Ω, then the voltage X(V) between the junction Q and the ground when the stereo headphone miniplug P-H is inserted in the jack J is calculated according to the equation (1) as follows:

$$0.5\times600/(100+600)=300/700=0.43 \text{ (V)}$$

The second information-handling apparatus connected to the stereo AV miniplug P-AV or the AV (audio/video) apparatus 12 as the second stereo audio/video apparatus has a rated resistance (impedance) of 2.2 kΩ. Therefore, the voltage X(V) between the junction Q and the ground when the stereo AV miniplug P-AV is inserted in the jack J is calculated according to the equation (1) as follows:

$$0.5\times2200/(100+2200)=1100/2300=0.49 \text{ (V)}$$

The plug determining circuit 8 compares the voltage at the junction Q with a reference voltage of 0.46 (V) in a step ST-2. If the voltage at the junction Q is lower than the reference voltage, then it is determined that the stereo headphone miniplug P-H is inserted in the jack J. Of the amplifiers 1, 2, 3 which have been de-energized, the headphone audio amplifier 1 is energized at a time t4 after the time t3 in a step ST-3.

If the voltage at the junction Q is higher than the reference voltage, then it is determined that the stereo AV miniplug P-AV is inserted in the jack J. Of the amplifiers 1, 2, 3 which have been de-energized, the line output audio amplifier 2 and the video output amplifier 3 are energized at the time t4 after the time t3 in a step ST-4.

Figure 5:
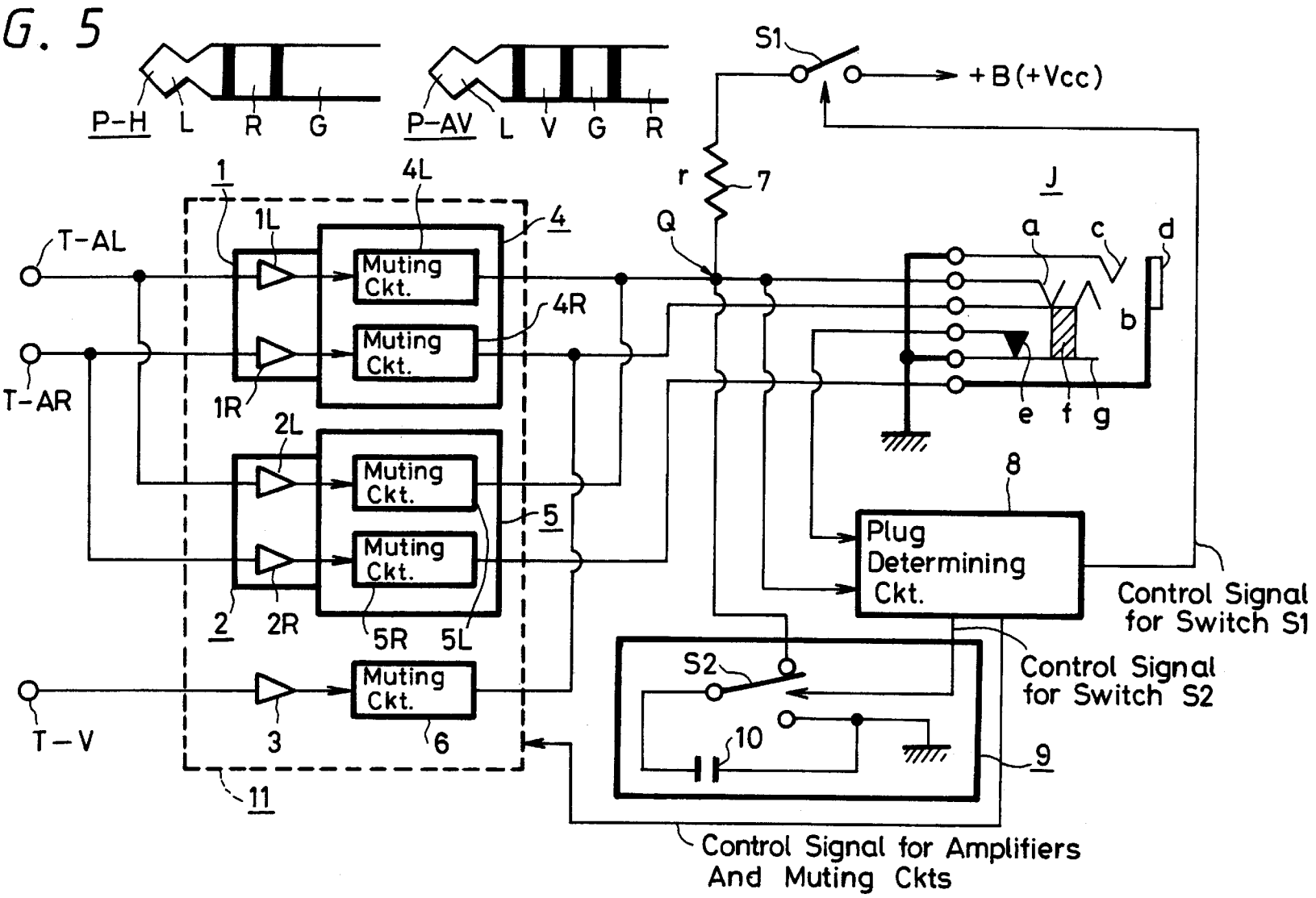
FIG. 5 is a block diagram of a connector device according to the second embodiment.

A connector device according to a second embodiment of the present invention will be described below. The connector device according to the second embodiment has a circuit arrangement as shown in FIG. 5. Those parts of the connector device shown in FIG. 5 which are identical to those shown in FIG. 2 are denoted by identical reference numerals and representations and will not be described in detail below. The connector device according to the second embodiment differs from the connector device according to the first embodiment in that it has a popcorn noise reducer 9 for reducing popcorn noise that is generated when the voltage at the junction Q rises sharply, and muting circuits 4, 5, 6 connected respectively to the output terminals of the amplifiers 1, 2, 3 for reducing popcorn noise which is generated when the amplifiers 1, 2, 3 are energized.

The popcorn noise reducer 9 comprises a capacitor 10 connected between the junction Q and the ground and having a capacitance of 0.1 μF, for example, and a selector switch S2 for selectively opening and short-circuiting the capacitor 10. A resistor may be inserted in series with the capacitor 10 when the capacitor 10 is short-circuited. The switching operation of the switch S2 is controlled by a control signal from the plug determining circuit 8.

The muting circuit 4 comprises muting circuits 4L, 4R connected respectively to the output terminals of the left and right amplifiers 1L, 1R of the headphone audio amplifier 1. The muting circuit 5 comprises muting circuits 5L, 5R connected respectively to the output terminals of the left and right amplifiers 2L, 2R of the line output audio amplifier 2. The muting circuit 6 is connected to the output terminal of the video output amplifier 3.

Operation of the connector device according to the second embodiment shown in FIG. 5 will be described below with reference to a timing chart shown in FIGS. 6A through 6H and an algorithm of the plug determining circuit 8 shown in FIG. 7.

When the stereo headphone miniplug P-H or the stereo AV miniplug P-AV is inserted into the jack J, the contacts a, b which have been held in contact with each other are separated from each other, and the contact b depresses the contact g through the insulator f, separating the contacts e, g out of contact with each other. It is assumed, as shown in FIG. 6A, that the stereo headphone miniplug P-H or the stereo AV miniplug P-AV is inserted into the jack J at a time t1 while the power supply is being switched on, or the power supply is switched on (whose level changes from a logic 0 to a logic 1) at a time t1 while the stereo headphone miniplug P-H or the stereo AV miniplug P-AV is being inserted in the jack J. The contact e, which has been connected to ground, becomes free, enabling the plug determining circuit 8 to detect that the stereo headphone miniplug P-H or the stereo AV miniplug P-AV is inserted in the jack J at the time t1.

The plug determining circuit 8, which has detected a level "0" so far, supplies a control signal (whose level changes from a logic 0 to a logic 1) to the switch S2 at a time t2, a certain period after the time t1, to shift a movable contact of the switch S2 from a ground contact (off) to a contact connected to the junction Q (on) at a time t3, a certain period after the time t2, for thereby operating the popcorn noise reducer 9 in a step ST-1 (see FIG. 7).

At a time t4, a certain period after the time t3, the plug determining circuit 8 supplies a control signal (whose level changes from a logic 0 to a logic 1) to turn on the switch S1 to the switch S1, which is turned on at a time t5, a certain period after the time t4, applying the DC voltage+Vcc from the power supply+B through the resistor 7 to the junction Q in a step ST-2. The potential at the junction Q gradually rises from 0 (V) to a voltage X (V) at a time t8, for example, and the voltage X(V) is supplied to the plug determining circuit 8. The voltage X (V) at the junction Q is expressed by the equation (1) described above.

The plug determining circuit 8 compares the voltage at the junction Q with a reference voltage in a step ST-3. If the voltage at the junction Q is lower than the reference voltage, then it is determined that the stereo headphone miniplug P-H is inserted in the jack J. At a time t6, a certain period after the time t5, the plug determining circuit 8 supplies a control signal (whose level changes from a logic 1 to a logic 0) to shift the movable contact of the switch S2 from the contact connected to the junction Q (on) to the ground contact (off), thus shifting the movable contact of the switch S2 from the contact connected to the junction Q (on) to the ground contact (off) at a time t7, a certain period after the time t6, so that the capacitor 10 is disconnected from the junction Q and short-circuited by the movable contact of the switch S2 to drain stored charges to ground in a step ST-4. At the time t8, a certain period after the time t7, the plug determining circuit 8 supplies a control signal (whose level changes from a logic 0 to a logic 1) to turn on the muting circuit 4 to the muting circuit 4, thereby energizing the muting circuit 4 in a step ST-5. At a time t9, a certain period after the time t8, the plug determining circuit 8 supplies a control signal (whose level changes from a logic 0 to a logic 1) to turn on the headphone audio amplifier 1 to the headphone audio amplifier 1, thereby energizing the headphone audio amplifier 1 in a step ST-6. At a time t10, a certain period after the time t9, the plug determining circuit 8 supplies a control signal (whose level changes from a logic 1 to a logic 0) to turn off the muting circuit 4 to the muting circuit 4, thereby de-energizing the muting circuit 4 in a step ST-7.

If the voltage at the junction Q is higher than the reference voltage in the step ST-3, then it is determined that the stereo AV (audio/video) miniplug P-AV is inserted in the jack J. At the time t6, the plug determining circuit 8 supplies a control signal (whose level changes from a logic 1 to a logic 0) to shift the movable contact of the switch S2 from the contact connected to the junction Q (on) to the ground contact (off), thus shifting the movable contact of the switch S2 to the ground contact (off) at the time t7, so that the capacitor 10 drains stored charges to ground in a step ST-8. At the time t8, the plug determining circuit 8 supplies a control signal (whose level changes from a logic 0 to a logic 1) to turn on the muting circuits 5, 6 to the muting circuits 5, 6, thereby energizing the muting circuits 5, 6 in a step ST-9. At the time t9, the plug determining circuit 8 supplies a control signal (whose level changes from a logic 0 to a logic 1) to turn on the line output audio amplifier 2 and the video output amplifier 3, thereby energizing the line output audio amplifier 2 and the video output amplifier 3 in a step ST-10. At the time t10, the plug determining circuit 8 supplies a control signal (whose level changes from a logic 1 to a logic 0) to turn off the muting circuits 5, 6 to the muting circuits 5, 6, thereby de-energizing the muting circuits 5, 6 in a step ST-11.

Each of the first information-handling apparatuses may comprise an audio device, a video device, or an audio/video device. The plugs that can be connected to the common jack connected to the first information-handling apparatus and can be distinguished depending on the different impedances of the second information-handling apparatus may be stereo plugs, monaural plugs, microphone plugs, etc.

If the impedance between the second contact R, as counted from the tip end, and the ground contact G of the stereo headphone miniplug P-H connected to the jack J and the impedance between the second contact V, as counted from the tip end, and the ground contact G of the stereo AV (audio/video) miniplug P-AV are to be determined for their magnitude by the plug determining circuit 8, the DC voltage+Vcc from the power supply+B may be applied through the resistor 7 to the contact b of the jack J, i.e., the junction Q, and the voltage at the junction Q may be supplied to the plug determining circuit 8.

While the first and second contacts, as counted from the tip end, of the stereo headphone miniplug P-H are the left and right audio signal contacts L, R, respectively, according to standards, it is also technically possible to use the first and second contacts of the stereo headphone miniplug P-H respectively as the right and left audio signal contacts R, L. Similarly, while the first and fourth contacts, as counted from the tip end, of the stereo AV (audio/video) miniplug P-AV are the left and right audio signal contacts L, R, respectively, according to standards, it also is technically possible to use the first and fourth contacts of the stereo AV (audio/video) miniplug P-AV respectively as the right and left audio signal contacts R, L.

The principles of the present invention are also applicable to a connector device having a common jack connected to a first information-handling apparatus and a plurality of plugs connected respectively to a plurality of second information-handling apparatuses having respective different impedances, the plugs being selectively connectable to the jack such that an arbitrary one of the plugs can be connected to the jack for transmitting an information signal from the first information-handling apparatus to one of the second information-handling apparatuses, and transmitting an information signal from one of the second information-handling apparatuses to the first information-handling apparatus.

The principles of the present invention are also applicable to a connector device having a common jack for selectively connecting, to a first stereo audio/video apparatus comprising first and second stereo audio devices having different first and second impedances, respectively, and a first video device, a third stereo audio device having an impedance which is substantially equal to the first impedance, and a second stereo audio/video apparatus comprising a fourth stereo audio device having an impedance which is substantially equal to the second impedance, and a second video device. The common jack is mounted on the first stereo audio/video apparatus, a first plug is mounted on the third stereo audio device and connectable to the common jack, and a second plug is mounted on the second stereo audio/video apparatus and connectable to the common jack, the first plug being connected to left and right audio signal terminals of the third stereo audio device, the second plug being connected to left and right audio signal terminals of the fourth stereo audio device and a video signal terminal of the second video device, whereby an audio or video signal from the first stereo audio/video apparatus will be supplied to the third stereo audio device or the second stereo audio/video apparatus, and an audio or video signal from the second stereo audio/video apparatus will be supplied to the first stereo audio/video apparatus.

In the connector device, the impedance of each of the above devices is either an input impedance or an output impedance depending on the direction in which signals are transmitted between the common plug and the first and second plugs connectable thereto.

According to a first arrangement of the present invention, there is provided a connector device having a common jack connected to a first information-handling apparatus, a plurality of plugs connected respectively to a plurality of second information-handling apparatuses having respective different impedances, the plugs being selectively connectable to the jack, and determining means for, when one of the plugs is connected to the common jack, applying a predetermined voltage through an impedance element to a contact of the connected plug, detecting a voltage between the contact of the connected plug and a ground contact thereof, detecting an impedance between the contact and the ground contact depending on the detected voltage, and determining the type of the plug or the type of the second information-handling apparatus connected to the plug depending on the detected impedance. The connector device allows the first information-handling apparatus to have a reduced space for accommodating the jack and the plugs.

According to a second arrangement of the present invention, there is provided a connector device having a common jack for selectively connecting, to a first stereo audio/video apparatus comprising first and second stereo audio devices having different first and second impedances, respectively, and a first video device, a third stereo audio device having an impedance which is substantially equal to the first impedance, and a second stereo audio/video apparatus comprising a fourth stereo audio device having an impedance which is substantially equal to the second impedance, and a second video device, the common jack being mounted on the first stereo audio/video apparatus, a first plug mounted on the third stereo audio device and connectable to the common jack, a second plug mounted on the second stereo audio/video apparatus and connectable to the common jack, the first plug being connected to left and right audio signal terminals of the third stereo audio device, the second plug being connected to left and right audio signal terminals of the fourth stereo audio device and a video signal terminal of the second video device, the first plug having a left (or right) audio signal contact, a right (or left) audio signal contact, and a ground contact, arranged successively from a tip end thereof, the second plug having a left (or right) audio signal contact, a video signal contact, a ground contact, and a right (or left) audio signal contact, arranged successively from a tip end thereof, and plug determining means connected to the common jack, for, when the first or second plug is connected to the common jack, determining whether an impedance between the first contact, as counted from the tip end, and the ground contact of the first or second plug is the first impedance or the second impedance thereby to determine whether the plug connected to the common jack is the first or second plug, energizing the first stereo audio device if the plug connected to the common jack is the first plug, and energizing the second stereo audio device and the first video device if the plug connected to the common jack is the second plug. The connector device allows the first stereo audio/video apparatus to have a reduced space for accommodating the jack and the plugs.

According to a third arrangement of the present invention, in the connector device according to the second arrangement, the plug determining means applies through the common jack a predetermined voltage through an impedance element to the first contact, as counted from the tip end, of the first or second plug, and determines whether the impedance between the first contact, as counted from the tip end, and the ground contact of the first or second plug is the first impedance or the second impedance depending on the voltage at the first contact, and the connector device also has rising voltage moderating means for moderating a rise in the predetermined voltage. Therefore, the connector device is capable of reducing popcorn noise even when the voltage is applied through the impedance element to the first contact, as counted from the tip end, of the first or second plug.

According to a fourth arrangement of the present invention, the connector device according to the second arrangement further includes muting circuits connected to signal paths of the first and second stereo signal devices and the video devices, and, when the first and second stereo signal devices and the video devices are energized, the plug determining means turns on the corresponding muting circuits for an interval over a time at which the first and second stereo signal devices and the video devices are energized. Therefore, when the first and second stereo signal devices and the video devices are energized under the control of the plug determining means, popcorn noise generated upon energization of the first and second stereo signal devices and the video devices can be reduced.

Having described preferred embodiments of the invention with reference to the accompanying drawings, it is to be understood that the invention is not limited to those precise embodiments and that various changes and modifications could be effected by one skilled in the art without departing from the spirit or scope of the invention as defined in the appended claims.

What is claimed is:

1. A connector device for connecting information-handling apparatuses, comprising:

a common jack connected to a first information-handling apparatus;

a plurality of plugs connected respectively to a plurality of second information-handling apparatuses having respective different impedances, said plugs being selectively connected to said common jack;

switch means connected between a DC power supply and one terminal of said common jack; and determining means connected to said common jack and said switch means for detecting when one of said plugs is connected to said common jack and providing a control signal to said switch means for connecting a DC power supply voltage to a predetermined terminal of said common jack and for measuring a voltage at said predetermined terminal and determining a type of a second information-handling apparatus connected to said connected plug depending on the voltage measured at said predetermined terminal of said common jack.

2. The connector device according to claim 1, wherein said first information-handling apparatus includes a circuit which is controlled based on one of said type of said connected plug and said type of said second information-handling apparatus connected to said connected plug as determined by said determining means.

3. A connector device for connecting information-handling apparatuses, comprising:

a common jack for selectively connecting, to a first stereo audio/video apparatus comprising first and second stereo audio devices having respective different first and second impedances and a first video device, a third stereo audio device having an impedance which is substantially equal to said first impedance, and a second stereo audio/video apparatus comprising a fourth stereo audio device having an impedance which is substantially equal to said second impedance, and a second video device, said common jack being mounted on said first stereo audio/video apparatus;

a first plug mounted on said third stereo audio device and for connection to said common jack;

a second plug mounted on said second stereo audio/video apparatus and for connection to said common jack;

said first plug being connected to left and right audio signal terminals of said fourth stereo audio device and a video signal terminal of said second video device;

said first plug having one of a left and right audio signal contact, one of a right and left audio signal contact, and a ground contact arranged successively from a tip end thereof;

said second plug having one of a left and right audio signal contact, a video signal contact, a ground contact, and one of a right and left audio signal contact arranged successively from a tip end thereof; and plug determining means connected to said common jack for determining, when one of said first and second plugs is connected to said common jack, whether an impedance between a first contact, as counted from a tip end of one of said first and second plugs, and a ground contact of one of said first and second plugs is one of said first impedance and said second impedance so as to determine whether a plug connected to said common jack is one of said first and second plugs, energizing said first stereo audio device if said plug connected to said common jack is said first plug, and energizing said second stereo audio device and said first video device if said plug connected to said common jack is said second plug.

4. The connector device according to claim 3, wherein each of said first video device and said second video device has an impedance which is substantially equal to said second impedance.

5. The connector device according to claim 3, wherein said plug determining means comprises means for applying, through said common jack and an impedance element, a predetermined voltage to said first contact of one of said first and second plugs, and determining whether said impedance between said first contact and said ground contact of one of said first and second plugs is one of said first impedance and second impedance depending on said predetermined voltage at said first contact; said connector device further comprising:

rising voltage moderating means for moderating a rise in said predetermined voltage.

6. The connector device according to claim 4, wherein said plug determining means comprises means for applying, through said common jack and an impedance element, a predetermined voltage to said first contact of one of said first and second plugs, and determining whether said impedance between said first contact, and said ground contact of one of said first and second plugs is one of said first impedance and second impedance depending on said predetermined voltage at said first contact; said connector device further comprising:

rising voltage moderating means for moderating a rise in said predetermined voltage.

7. The connector device according to claim 3, further comprising:

muting circuits connected to signal paths of said first and second stereo audio devices and said first and second video devices;

said plug determining means comprising means for, when said first and second stereo audio devices and said first and second video devices are energized, turning on corresponding muting circuits for an interval of time during which said first and second stereo audio devices and said first and second video devices are energized.

8. The connector device according to claim 3, wherein each of said first and second stereo audio devices and said first and second video devices comprises an amplifier.

9. The connector device according to claim 8, wherein said third stereo audio device comprises a headphone.

10. The connector device according to claim 3, wherein said first plug comprises a plug for a stereo headphone, and said second plug comprises a plug for stereo audio/video signals.

* * * * *